US008342611B2

(12) United States Patent
Hall et al.

(10) Patent No.: US 8,342,611 B2
(45) Date of Patent: Jan. 1, 2013

(54) SPRING LOADED PICK

(75) Inventors: David R. Hall, Provo, UT (US); Ronald B. Crockett, Payson, UT (US); Francis Leany, Salem, UT (US)

(73) Assignee: Schlumberger Technology Corporation, Houston, TX (US)

( * ) Notice: Subject to any disclaimer, the term of this patent is extended or adjusted under 35 U.S.C. 154(b) by 0 days.

(21) Appl. No.: 12/963,464

(22) Filed: Dec. 8, 2010

(65) Prior Publication Data

US 2011/0080036 A1 Apr. 7, 2011

Related U.S. Application Data

(62) Division of application No. 11/749,039, filed on May 15, 2007, now Pat. No. 7,926,883.

(51) Int. Cl.
*E21C 35/18* (2006.01)

(52) U.S. Cl. ..... 299/107

(58) Field of Classification Search ..... 299/95, 299/100–113

See application file for complete search history.

(56) References Cited

U.S. PATENT DOCUMENTS

| | | | |
|---|---|---|---|
| 465,103 | A | 12/1891 | Wegner |
| 616,118 | A | 12/1898 | Kunhe |
| 946,060 | A | 1/1910 | Looker |
| 1,116,154 | A | 11/1914 | Stowers |
| 1,183,630 | A | 5/1916 | Bryson |
| 1,189,560 | A | 7/1916 | Gondos |
| 1,360,908 | A | 11/1920 | Everson |
| 1,387,733 | A | 8/1921 | Midgett |
| 1,460,671 | A | 7/1923 | Hebsacker |
| 1,544,757 | A | 7/1925 | Hufford et al. |
| 1,821,474 | A | 9/1931 | Mercer |
| 1,879,177 | A | 9/1932 | Gault |
| 2,004,315 | A | 6/1935 | Fean |
| 2,054,255 | A | 9/1936 | Howard |
| 2,064,255 | A | 12/1936 | Garfield |
| 2,124,438 | A | 7/1938 | Struk et al. |
| 2,169,223 | A | 8/1939 | Christian |
| 2,218,130 | A | 10/1940 | Court |
| 2,255,650 | A | 9/1941 | Burke |
| 2,320,136 | A | 5/1943 | Kammerer |
| 2,466,991 | A | 4/1949 | Kammerer |
| 2,540,464 | A | 2/1951 | Stokes |
| 2,544,036 | A | 3/1951 | Kammerer |
| 2,720,392 | A | 10/1955 | Cartlidge |
| 2,755,071 | A | 7/1956 | Kammerer |
| 2,776,819 | A | 1/1957 | Brown |
| 2,819,043 | A | 1/1958 | Henderson |
| 2,838,284 | A | 6/1958 | Austin |
| 2,894,722 | A | 7/1959 | Buttolph |
| 2,901,223 | A | 8/1959 | Scott |

(Continued)

FOREIGN PATENT DOCUMENTS

| | | |
|---|---|---|
| DE | 3 307 910 | 9/1984 |

(Continued)

*Primary Examiner* — Sunil Singh

(74) *Attorney, Agent, or Firm* — Brinks Hofer Gilson & Lione

(57) ABSTRACT

In one aspect of the invention, an apparatus for degrading natural and man-made formations includes a pick with an axially spring loaded pick comprising a central axis and being attached to a holder secured to a driving mechanism. The pick comprising a steel body with an axial shank disposed within a bore of the holder.

7 Claims, 10 Drawing Sheets

U.S. PATENT DOCUMENTS

| | | | | |
|---|---|---|---|---|
| 2,963,102 | A | | 12/1960 | Smith |
| 2,989,295 | A | | 6/1961 | Prox, Jr. |
| 3,135,341 | A | | 6/1964 | Ritter |
| 3,254,392 | A | | 6/1966 | Novkov |
| 3,294,186 | A | | 12/1966 | Buell |
| 3,301,339 | A | | 1/1967 | Pennebaker, Jr. |
| 3,336,081 | A | | 8/1967 | Griffin |
| 3,342,531 | A | | 9/1967 | Krekeler |
| 3,342,532 | A | | 9/1967 | Krekeler |
| 3,379,264 | A | | 4/1968 | Cox |
| 3,397,012 | A | | 8/1968 | Krekeler |
| 3,397,013 | A | | 8/1968 | Krekeler |
| 3,429,390 | A | | 2/1969 | Bennett |
| 3,429,617 | A | | 2/1969 | Lauber |
| 3,468,553 | A | | 9/1969 | Ashby et al. |
| 3,493,165 | A | | 2/1970 | Schonfeld |
| 3,498,677 | A | | 3/1970 | Morrow |
| 3,512,838 | A | | 5/1970 | Kniff |
| 3,550,960 | A | | 12/1970 | Holder |
| 3,583,504 | A | | 6/1971 | Aalund |
| 3,627,381 | A | | 12/1971 | Krekeler |
| 3,650,565 | A | | 3/1972 | Kniff |
| 3,655,244 | A | | 4/1972 | Swisher |
| 3,745,396 | A | | 7/1973 | Quintal et al. |
| 3,746,396 | A | | 7/1973 | Radd |
| 3,751,115 | A | | 8/1973 | Proctor |
| 3,765,493 | A | | 10/1973 | Rosar et al. |
| 3,767,266 | A | | 10/1973 | Krekeler |
| 3,778,112 | A | | 12/1973 | Krekeler |
| 3,801,158 | A | | 4/1974 | Radd et al. |
| 3,807,804 | A | | 4/1974 | Kniff |
| 3,820,848 | A | | 6/1974 | Kniff |
| 3,830,321 | A | | 8/1974 | McKenry |
| 3,833,265 | A | | 9/1974 | Elders |
| 3,856,107 | A | * | 12/1974 | Rabett ..... 181/207 |
| 3,865,437 | A | | 2/1975 | Crosby |
| 3,932,952 | A | | 1/1976 | Helton et al. |
| 3,942,838 | A | | 3/1976 | Bailey et al. |
| 3,945,681 | A | | 3/1976 | White |
| 3,957,307 | A | | 5/1976 | Varda |
| 3,960,223 | A | | 6/1976 | Kleine |
| 4,005,914 | A | | 2/1977 | Newman |
| 4,006,936 | A | | 2/1977 | Crabiel |
| 4,081,042 | A | | 3/1978 | Johnson et al. |
| 4,084,856 | A | | 4/1978 | Emmerich et al. |
| 4,098,362 | A | | 7/1978 | Bonnice |
| 4,106,577 | A | | 8/1978 | Summers |
| 4,109,737 | A | | 8/1978 | Bovenkerk |
| 4,149,753 | A | | 4/1979 | Stoltz |
| 4,156,329 | A | | 5/1979 | Daniels |
| 4,199,035 | A | | 4/1980 | Thompson |
| 4,201,421 | A | | 5/1980 | Den Besten |
| 4,247,150 | A | | 1/1981 | Wrulich et al. |
| 4,251,109 | A | | 2/1981 | Roepke |
| 4,268,089 | A | | 5/1981 | Spence et al. |
| 4,277,106 | A | | 7/1981 | Sahley |
| 4,289,211 | A | | 9/1981 | Lumen |
| 4,302,053 | A | | 11/1981 | Roepke et al. |
| 4,307,786 | A | | 12/1981 | Evans |
| 4,337,980 | A | | 7/1982 | Krekeler |
| 4,397,362 | A | | 8/1983 | Dice et al. |
| 4,416,339 | A | | 11/1983 | Baker et al. |
| 4,439,250 | A | | 3/1984 | Acharya et al. |
| 4,448,269 | A | | 5/1984 | Ishikawa et al. |
| 4,453,775 | A | | 6/1984 | Clemmow |
| 4,465,221 | A | | 8/1984 | Schmidt |
| 4,484,644 | A | | 11/1984 | Cook et al. |
| 4,484,783 | A | | 11/1984 | Emmerich |
| 4,489,986 | A | | 12/1984 | Dziak |
| 4,497,520 | A | | 2/1985 | Ojanen |
| 4,531,592 | A | | 7/1985 | Hayatdavoudi |
| 4,537,448 | A | | 8/1985 | Ketterer |
| 4,542,942 | A | | 9/1985 | Zitz et al. |
| 4,566,545 | A | | 1/1986 | Story et al. |
| 4,573,744 | A | | 3/1986 | Clemmow et al. |
| 4,579,491 | A | | 4/1986 | Kull |
| 4,583,786 | A | | 4/1986 | Thorpe et al. |
| 4,627,665 | A | | 12/1986 | Ewing et al. |
| 4,647,111 | A | | 3/1987 | Bronder et al. |
| 4,657,308 | A | | 4/1987 | Clapham |
| 4,660,890 | A | | 4/1987 | Mills |
| 4,669,786 | A | | 6/1987 | Morgan et al. |
| 4,678,237 | A | | 7/1987 | Collin |
| 4,682,987 | A | | 7/1987 | Brady et al. |
| 4,684,176 | A | | 8/1987 | Den Besten et al. |
| 4,688,856 | A | | 8/1987 | Elfgen |
| 4,694,918 | A | | 9/1987 | Hall |
| 4,702,525 | A | | 10/1987 | Sollami et al. |
| 4,725,098 | A | | 2/1988 | Beach |
| 4,728,153 | A | | 3/1988 | Ojanen et al. |
| 4,729,603 | A | | 3/1988 | Elfgen |
| 4,736,533 | A | | 4/1988 | May et al. |
| 4,746,379 | A | | 5/1988 | Rabinkin |
| 4,765,686 | A | | 8/1988 | Adams |
| 4,765,687 | A | | 8/1988 | Parrott |
| 4,776,862 | A | | 10/1988 | Wiand |
| 4,804,231 | A | | 2/1989 | Buljan et al. |
| 4,811,801 | A | | 3/1989 | Salesky et al. |
| 4,836,614 | A | | 6/1989 | Ojanen |
| 4,850,649 | A | | 7/1989 | Beach et al. |
| 4,880,154 | A | | 11/1989 | Tank |
| 4,893,875 | A | | 1/1990 | Lonn et al. |
| 4,907,665 | A | | 3/1990 | Kar et al. |
| 4,921,310 | A | | 5/1990 | Hedlund et al. |
| D308,683 | S | | 6/1990 | Meyers |
| 4,932,723 | A | | 6/1990 | Mills |
| 4,940,288 | A | | 7/1990 | Stiffler |
| 4,944,559 | A | | 7/1990 | Sionnet et al. |
| 4,951,762 | A | | 8/1990 | Lundell |
| 4,956,238 | A | | 9/1990 | Griffin |
| 4,962,822 | A | | 10/1990 | Pascale |
| 5,007,685 | A | | 4/1991 | Beach et al. |
| 5,009,273 | A | | 4/1991 | Grabinski |
| 5,011,515 | A | | 4/1991 | Frushour |
| 5,018,793 | A | | 5/1991 | Den Besten |
| 5,038,873 | A | | 8/1991 | Jurgens |
| 5,074,063 | A | | 12/1991 | Vannette |
| 5,088,797 | A | | 2/1992 | O'Neill |
| 5,092,310 | A | | 3/1992 | Walen et al. |
| 5,106,166 | A | | 4/1992 | O'Neill |
| 5,112,165 | A | | 5/1992 | Hedlund |
| 5,119,714 | A | | 6/1992 | Scott et al. |
| 5,141,063 | A | | 8/1992 | Quesenbury |
| 5,141,289 | A | | 8/1992 | Stiffler |
| 5,154,245 | A | | 10/1992 | Waldenstrom |
| 5,186,892 | A | | 2/1993 | Pope |
| 5,219,380 | A | | 6/1993 | Young et al. |
| 5,235,961 | A | | 8/1993 | McShannon |
| 5,251,964 | A | | 10/1993 | Ojanen |
| 5,261,499 | A | | 11/1993 | Grubb |
| D342,268 | S | | 12/1993 | Meyer |
| 5,303,984 | A | | 4/1994 | Ojanen |
| 5,311,654 | A | | 5/1994 | Cook |
| 5,319,855 | A | | 6/1994 | Beevers et al. |
| 5,332,051 | A | | 7/1994 | Knowlton |
| 5,332,348 | A | | 7/1994 | Lemelson |
| 5,335,977 | A | * | 8/1994 | Morrell et al. ..... 299/107 |
| 5,361,859 | A | | 11/1994 | Tibbitts |
| 5,374,111 | A | | 12/1994 | Den Besten et al. |
| 5,392,540 | A | | 2/1995 | Cooper et al. |
| 5,415,462 | A | | 5/1995 | Massa |
| 5,417,292 | A | | 5/1995 | Polakoff |
| 5,417,475 | A | | 5/1995 | Graham et al. |
| 5,447,208 | A | | 9/1995 | Lund |
| RE35,088 | E | | 11/1995 | Gilbert |
| 5,503,463 | A | | 4/1996 | Ojanen |
| 5,507,357 | A | | 4/1996 | Hult et al. |
| 5,535,839 | A | | 7/1996 | Brady |
| 5,542,993 | A | | 8/1996 | Rabinkin |
| 5,560,440 | A | | 10/1996 | Tibbitts |
| 5,568,838 | A | | 10/1996 | Struthers et al. |
| 5,653,300 | A | | 8/1997 | Lund |
| 5,662,720 | A | | 9/1997 | O'Tigheamaigh |
| 5,678,644 | A | | 10/1997 | Fielder |
| 5,720,528 | A | | 2/1998 | Ritchey |
| 5,722,733 | A | | 3/1998 | Tank et al. |
| 5,725,283 | A | | 3/1998 | O'Neill |

| | | | |
|---|---|---|---|
| 5,730,502 | A | 3/1998 | Montgomery, Jr. |
| 5,732,784 | A | 3/1998 | Nelson |
| 5,738,698 | A | 4/1998 | Kapoor et al. |
| 5,823,632 | A | 10/1998 | Burkett |
| 5,837,071 | A | 11/1998 | Andersson et al. |
| 5,842,747 | A | 12/1998 | Winchester |
| 5,845,547 | A | 12/1998 | Sollami |
| 5,848,657 | A | 12/1998 | Flood et al. |
| 5,875,862 | A | 3/1999 | Jurewicz |
| 5,890,552 | A | 4/1999 | Scott et al. |
| 5,896,938 | A | 4/1999 | Moeny et al. |
| 5,934,542 | A | 8/1999 | Nakamura |
| 5,935,718 | A | 8/1999 | Demo |
| 5,944,129 | A | 8/1999 | Jensen |
| 5,967,250 | A | 10/1999 | Lund |
| 5,992,405 | A | 11/1999 | Sollami |
| 6,000,483 | A | 12/1999 | Jurewicz et al. |
| 6,006,846 | A | 12/1999 | Tibbitts et al. |
| 6,019,434 | A | 2/2000 | Emmerich |
| 6,044,920 | A | 4/2000 | Massa et al. |
| 6,051,079 | A | 4/2000 | Andersson et al. |
| 6,056,911 | A | 5/2000 | Griffin |
| 6,059,373 | A | 5/2000 | Wright et al. |
| 6,065,552 | A | 5/2000 | Scott et al. |
| 6,068,072 | A | 5/2000 | Besson et al. |
| 6,099,081 | A | 8/2000 | Warren et al. |
| 6,102,486 | A | 8/2000 | Briese |
| 6,113,195 | A | 9/2000 | Mercier et al. |
| 6,170,917 | B1 | 1/2001 | Heinrich et al. |
| 6,193,770 | B1 | 2/2001 | Sung |
| 6,196,636 | B1 | 3/2001 | Mills |
| 6,196,910 | B1 | 3/2001 | Johnson |
| 6,199,645 | B1 | 3/2001 | Anderson et al. |
| 6,199,956 | B1 | 3/2001 | Kammerer |
| 6,202,761 | B1 | 3/2001 | Forney |
| 6,216,805 | B1 | 4/2001 | Lays et al. |
| 6,270,165 | B1 | 8/2001 | Peay |
| 6,331,035 | B1 | 12/2001 | Montgomery, Jr. |
| 6,332,503 | B1 | 12/2001 | Pessier et al. |
| 6,341,823 | B1 | 1/2002 | Sollami |
| 6,354,771 | B1 | 3/2002 | Bauschulte et al. |
| 6,357,832 | B1 | 3/2002 | Sollami |
| 6,364,420 | B1 | 4/2002 | Sollami |
| 6,371,567 | B1 | 4/2002 | Sollami |
| 6,375,272 | B1 | 4/2002 | Ojanen |
| 6,397,652 | B1 | 6/2002 | Sollami |
| 6,408,959 | B2 | 6/2002 | Bertagnolli et al. |
| 6,412,163 | B1 | 7/2002 | Russell |
| 6,419,278 | B1 | 7/2002 | Cunningham |
| 6,439,326 | B1 | 8/2002 | Huang et al. |
| 6,457,267 | B1 | 10/2002 | Porter et al. |
| 6,460,637 | B1 | 10/2002 | Siracki et al. |
| 6,478,383 | B1 | 11/2002 | Ojanen et al. |
| 6,481,803 | B2 | 11/2002 | Ritchey |
| 6,484,826 | B1 | 11/2002 | Anderson et al. |
| 6,499,547 | B2 | 12/2002 | Scott et al. |
| 6,508,516 | B1 | 1/2003 | Kammerer |
| 6,517,902 | B2 | 2/2003 | Drake et al. |
| 6,533,050 | B2 | 3/2003 | Molloy |
| 6,543,963 | B2 | 4/2003 | Bruso |
| 6,585,326 | B2 | 7/2003 | Sollami |
| 6,601,454 | B1 | 8/2003 | Botnan |
| 6,601,662 | B2 | 8/2003 | Matthias et al. |
| 6,644,755 | B1 | 11/2003 | Kammerer |
| 6,651,758 | B2 | 11/2003 | Xiang et al. |
| 6,668,949 | B1 | 12/2003 | Rives |
| 6,672,406 | B2 | 1/2004 | Beuershausen |
| 6,685,273 | B1 | 2/2004 | Sollami |
| 6,692,083 | B2 | 2/2004 | Latham |
| 6,702,393 | B2 | 3/2004 | Mercier |
| 6,709,065 | B2 | 3/2004 | Peay et al. |
| 6,719,074 | B2 | 4/2004 | Tsuda et al. |
| 6,732,817 | B2 | 5/2004 | Dewey et al. |
| 6,732,914 | B2 | 5/2004 | Cadden |
| 6,733,087 | B2 | 5/2004 | Hall et al. |
| 6,739,327 | B2 | 5/2004 | Sollami |
| 6,758,530 | B2 | 7/2004 | Sollami |
| 6,779,948 | B2 | 8/2004 | Bruso |
| 6,786,557 | B2 | 9/2004 | Montgomery, Jr. |
| 6,824,225 | B2 | 11/2004 | Stiffler |
| 6,846,045 | B2 | 1/2005 | Sollami |
| 6,851,758 | B2 | 2/2005 | Beach |
| 6,854,201 | B1 | 2/2005 | Hunter et al. |
| 6,854,810 | B2 | 2/2005 | Montgomery, Jr. |
| 6,861,137 | B2 | 3/2005 | Griffin et al. |
| 6,863,352 | B2 | 3/2005 | Sollami |
| 6,889,890 | B2 | 5/2005 | Yamazaki et al. |
| 6,918,636 | B2 | 7/2005 | Dawood |
| 6,929,076 | B2 | 8/2005 | Fanuel et al. |
| 6,938,961 | B2 | 9/2005 | Broom |
| 6,953,096 | B2 | 10/2005 | Gledhill et al. |
| 6,962,395 | B2 | 11/2005 | Mouthaan |
| 6,966,611 | B1 | 11/2005 | Sollami |
| 6,994,404 | B1 | 2/2006 | Sollami |
| 7,097,258 | B2 | 8/2006 | Sollami |
| 7,118,181 | B2 | 10/2006 | Frear |
| 7,150,131 | B2 | 12/2006 | Barker |
| 7,204,560 | B2 | 4/2007 | Mercier et al. |
| 7,234,782 | B2 | 6/2007 | Stehney |
| D560,699 | S | 1/2008 | Omi |
| 7,320,505 | B1 | 1/2008 | Hall et al. |
| 7,343,947 | B1 | 3/2008 | Sollami |
| 7,350,601 | B2 | 4/2008 | Belnap et al. |
| 7,369,743 | B2 | 5/2008 | Watkins et al. |
| 7,387,345 | B2 | 6/2008 | Hall et al. |
| 7,390,066 | B2 | 6/2008 | Hall et al. |
| 7,396,086 | B1 | 7/2008 | Hall et al. |
| 7,401,863 | B1 | 7/2008 | Hall et al. |
| 7,413,258 | B2 | 8/2008 | Hall et al. |
| 7,669,938 | B2 | 3/2010 | Hall et al. |
| 7,690,138 | B2 | 4/2010 | Hall et al. |
| 7,992,944 | B2 | 8/2011 | Hall et al. |
| 7,992,945 | B2 | 8/2011 | Hall et al. |
| 2001/0004946 | A1 | 6/2001 | Jensen |
| 2002/0070602 | A1 | 6/2002 | Sollami |
| 2002/0074851 | A1 | 6/2002 | Montgomery, Jr. |
| 2002/0153175 | A1 | 10/2002 | Ojanen |
| 2002/0175555 | A1 | 11/2002 | Mercier |
| 2003/0015907 | A1 | 1/2003 | Sollami |
| 2003/0047985 | A1 | 3/2003 | Stiffler |
| 2003/0052530 | A1 | 3/2003 | Sollami |
| 2003/0110667 | A1 | 6/2003 | Adachi |
| 2003/0137185 | A1 | 7/2003 | Sollami |
| 2003/0140360 | A1 | 7/2003 | Mansuy et al. |
| 2003/0141350 | A1 | 7/2003 | Noro |
| 2003/0141753 | A1 | 7/2003 | Peay et al. |
| 2003/0209366 | A1 | 11/2003 | McAlvain |
| 2003/0213354 | A1 | 11/2003 | Frers |
| 2003/0230926 | A1 | 12/2003 | Mondy |
| 2003/0234280 | A1 | 12/2003 | Cadden et al. |
| 2004/0026132 | A1 | 2/2004 | Hall et al. |
| 2004/0026983 | A1 | 2/2004 | McAlvain |
| 2004/0065484 | A1 | 4/2004 | McAlvain |
| 2005/0035649 | A1 | 2/2005 | Mercier |
| 2005/0044987 | A1 | 3/2005 | Takayama et al. |
| 2005/0159840 | A1 | 7/2005 | Lin et al. |
| 2005/0173966 | A1 | 8/2005 | Mouthaan |
| 2006/0006727 | A1 | 1/2006 | Frear |
| 2006/0086537 | A1 | 4/2006 | Dennis |
| 2006/0086540 | A1 | 4/2006 | Griffin |
| 2006/0125306 | A1 | 6/2006 | Sollami |
| 2006/0186724 | A1 | 8/2006 | Stehney |
| 2006/0237236 | A1 | 10/2006 | Sreshta et al. |
| 2006/0261663 | A1 | 11/2006 | Sollami |
| 2007/0013224 | A1 | 1/2007 | Stehney |
| 2008/0084106 | A1 | 4/2008 | Marathe et al. |
| 2009/0051211 | A1 | 2/2009 | Hall et al. |

FOREIGN PATENT DOCUMENTS

| | | |
|---|---|---|
| DE | 3 431 495 | 3/1986 |
| DE | 3500261 | 7/1986 |
| DE | 3818213 | 11/1989 |
| DE | 4 039 217 | 6/1992 |
| DE | 19 821 147 | 11/1999 |
| DE | 10163717 | 5/2003 |
| EP | 0 295 151 | 12/1988 |
| EP | 0 412 287 | 2/1991 |
| EP | 0 899 051 A1 | 3/1999 |

| | | | | | |
|---|---|---|---|---|---|
| EP | 1 574 309 | 9/2005 | JP | 5 280 273 | 10/1993 |
| GB | 2004315 | 3/1979 | RU | 2 079 651 | 5/1997 |
| GB | 2037223 | 11/1979 | | | |
| GB | 2423319 A | 8/2006 | | | |

* cited by examiner

SPRING LOADED PICK

CROSS REFERENCE TO RELATED APPLICATIONS

This application is a divisional of U.S. patent application Ser. No. 11/749,039 filed on May 15, 2007, now U.S. Pat. No. 7,926,883.

BACKGROUND OF THE INVENTION

Efficient degradation of materials is important to a variety of industries including the asphalt, mining, construction, drilling, and excavation industries. In the asphalt industry, pavement may be degraded using picks, and in the mining industry, picks may be used to break minerals and rocks. Picks may also be used when excavating large amounts of hard materials. In asphalt recycling and trenching, a drum or chain supporting an array of picks may rotate such that the picks engage a paved surface causing it to break up. Examples of degradation assemblies from the prior art are disclosed in U.S. Pat. No. 6,824,225 to Stiffler, U.S. Patent Publication No. 2005/0173966 to Mouthaan, U.S. Pat. No. 6,692,083 to Latham, U.S. Pat. No. 6,786,557 to Montgomery, Jr., U.S. Pat. No. 3,830,321 to McKenry et al., U.S. Patent Publication No. 2003/0230926, U.S. Pat. No. 4,932,723 to Mills, U.S. Patent Publication No. 2002/0175555 to Merceir, U.S. Pat. No. 6,854,810 to Montgomery, Jr., and U.S. Pat. No. 6,851,758 to Beach, which are all herein incorporated by reference for all they contain.

The picks typically have a tungsten carbide tip. Many efforts have been made to extend the life of these picks. Examples of such efforts are disclosed in U.S. Pat. No. 4,944,559 to Sionnet et al., U.S. Pat. No. 5,837,071 to Andersson et al., U.S. Pat. No. 5,417,475 to Graham et al., U.S. Pat. No. 6,051,079 to Andersson et al., U.S. Pat. No. 4,725,098 to Beach, U.S. Pat. No. 6,733,087 to Hall et al., U.S. Pat. No. 4,923,511 to Krizan et al., U.S. Pat. No. 5,174,374 to Hailey, and U.S. Pat. No. 6,868,848 to Boland et al., all of which are herein incorporated by reference for all that they disclose.

BRIEF SUMMARY OF THE INVENTION

In one aspect of the invention, an apparatus for degrading natural and man-made formations includes an axially spring loaded pick comprising a central axis and being attached to a holder secured to a driving mechanism. The pick comprising a steel body with an axial shank disposed within a bore of the holder.

The tip of the pick comprises a material selected from the group consisting of cubic boron nitride, diamond, diamond like material, carbide, a cemented metal carbide, or combinations thereof. The material may be at least 0.100 inches thick, and may have a 6% to 20% metal binder concentration by volume. The tip may also have a 0.050 to 0.200 inch apex radius. The steel body of the tip may have a carbide core and the tip may be brazed to the carbide core.

A spring mechanism may be built into the holder which allows the tip to engage the formation and then recoil away from the formation lessening drag that would otherwise occur on the tip. The recoiling effect is believed to reduce wear caused from the drag. The recoiling effect is also believed to degrade the formation in larger chucks than dragging the tip against the formation surface. The spring mechanism may comprise a coil spring, a compression spring, a tension spring, Belleville spring, wave spring, elastomeric material, gas spring, or combinations thereof. The pick may also comprise an axial shank which is press fit into the holder. The shank is secured within a holder which is secured to the driving mechanism.

The driving mechanism is a drum, chain, wheel, or combinations thereof. The driving mechanism may be attached to a trenching machine, excavator machine, pavement milling machine, a coal mining machine, or combinations thereof. The driving mechanism may be attached to a motorized vehicle with a dampening element adapted to insulate the vehicle from the vibrations of the driving mechanism. The dampening element may comprise a shock, an elastic material, or a combination thereof.

In another aspect of the invention, a method comprising the steps of providing an axially spring loaded pick comprising a central axis and being attached to a holder secured to a driving mechanism, the pick comprising a steel body with an axial shank disposed within a bore of the holder and comprising a tip with a hardness greater than 4000 HV; positioning the driving mechanism adjacent to the formation; and degrading the formation with a spring loaded pick by activating the driving mechanism. The formation may be pavement, coal, soil, rock, limestone, or a combination thereof.

DETAILED DESCRIPTION

Figure 1:
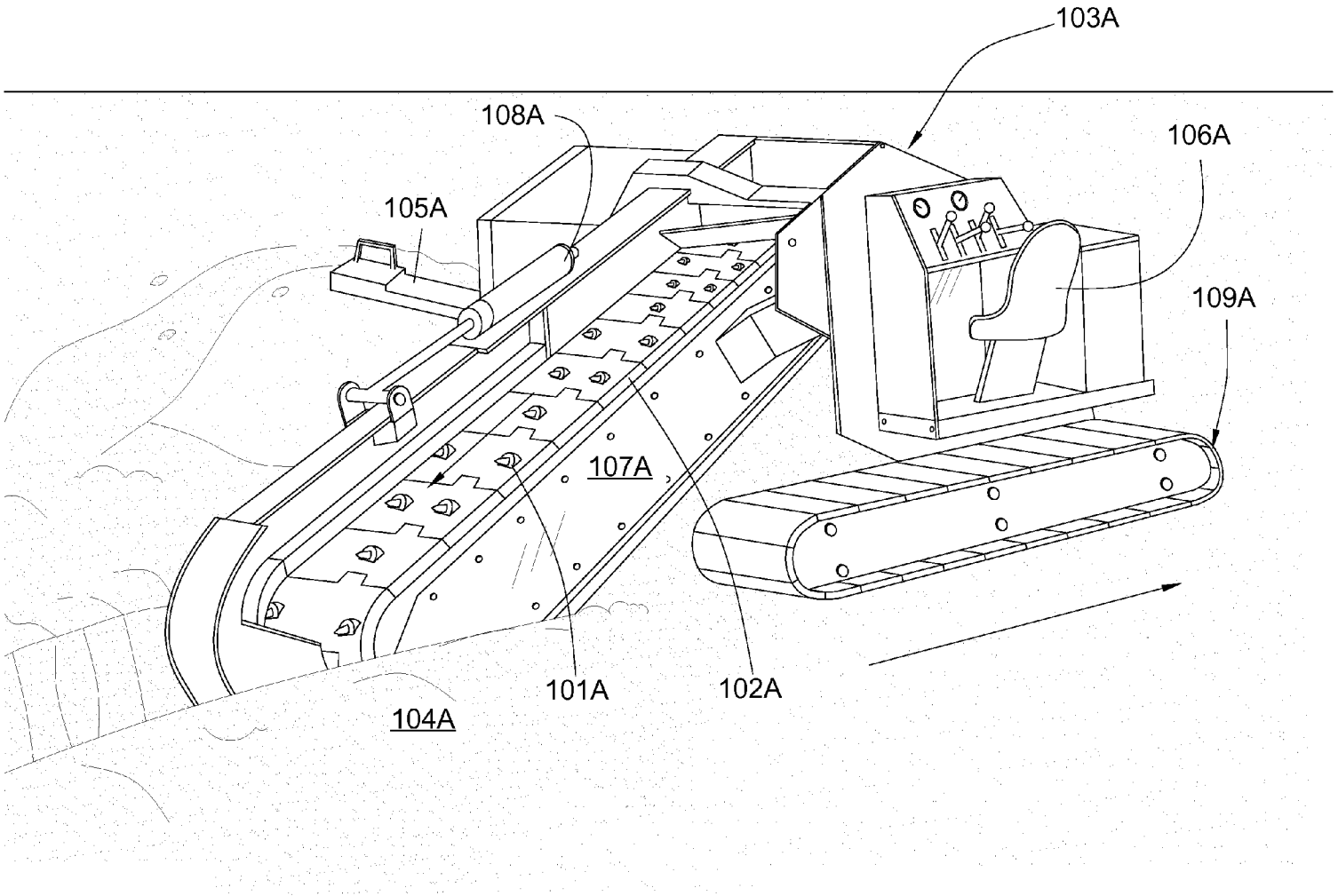
FIG. 1 is a perspective diagram of an embodiment of a plurality of picks on a rotating chain attached to a motor vehicle.

FIG. 1 is a perspective diagram of an embodiment of a plurality of picks 101A on a rotating chain 102A attached to a motor vehicle 103A. The plurality of picks 101A may be exteriorly mounted in a "V" pattern on the chain 102A to facilitate degradation and removal of a formation 104A. The rotating chain 102A rotates in the direction of the arrow and cuts the formation forming a trench while bringing the formation cuttings out of the trench to a conveyor belt 105A which directs the cuttings to a side of the trench. The rotating chain 102A is supported by an arm 107A. The arm 107A may be raised while the machine is being transported or it may be lowered for trenching as shown in FIG. 1. The position of the arm 107A may be controlled by a hydraulic piston and cylinder 108A. The motor vehicle 103A may move about the formation 104A by tracks 109A, wheels, or a combination thereof. A seat 106A for an operator is positioned on the side of the motor vehicle 103A.

Figure 2:
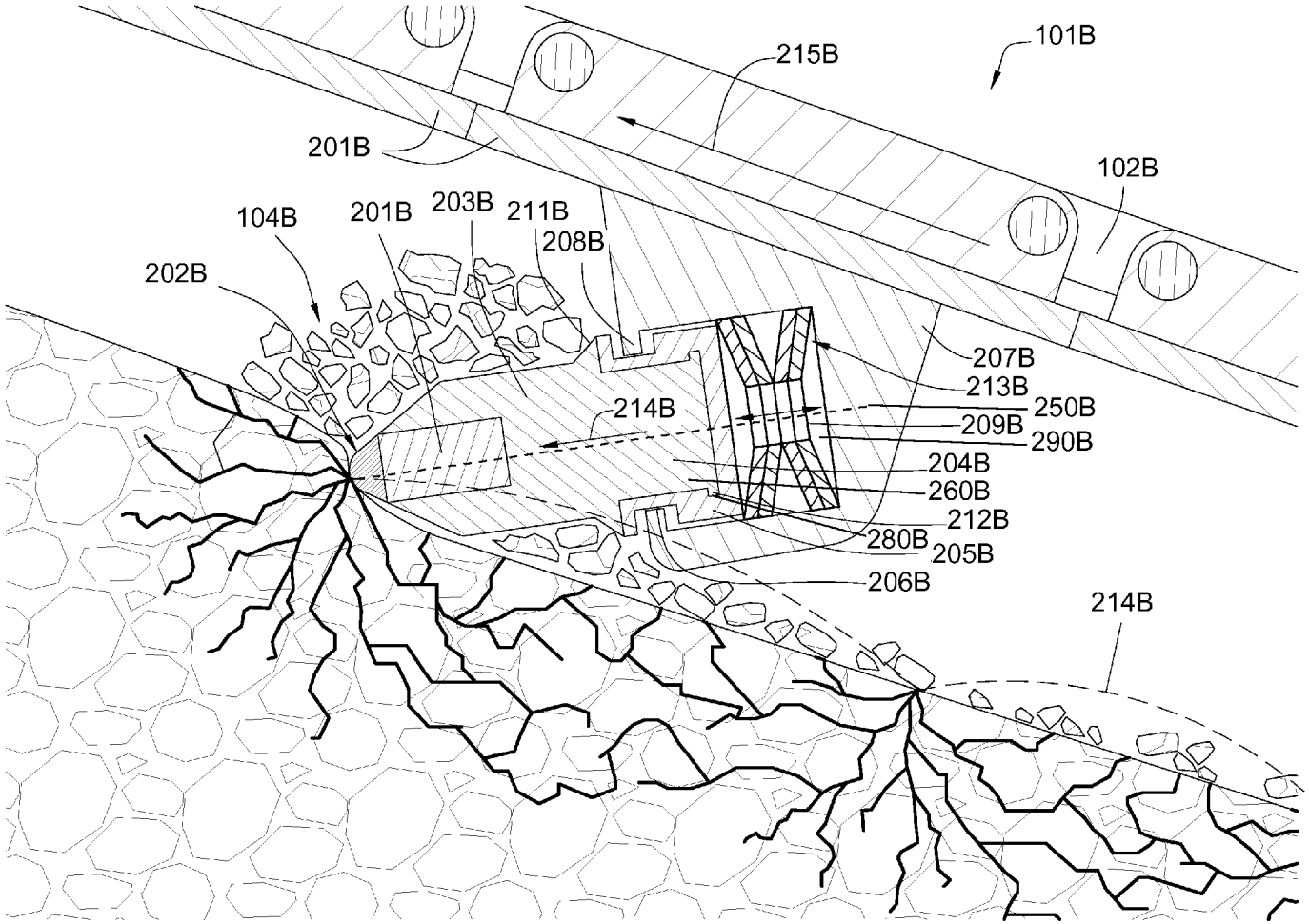
FIG. 2 is a cross-sectional diagram of an embodiment of a pick degrading a formation

FIG. 2 is a perspective diagram of an embodiment of a pick 101B degrading a formation 104B. The pick 101B has a carbide core 201B attached to an impact tip 202B and is press fit into a recess 270B of a steel body 203B. The steel body 203B has a shank 204B which is press fit into a cavity 260B of a carrier 205B so as to have a base 211B of the pick 101B flush against a distal end of the carrier 205B. The shank 204B has a flange 212B that extends into a recess 280B of the cavity 260B of the carrier 205B that keeps the shank 204B interiorly locked to the carrier 205B. The carrier 205B has indents 206B so as to stay within a cavity 290B of a holder 207B. The holder 207B has fingers 208B that interface with the indents 206B so as to limit the movement of the pick 101B. The holder 207B includes a spring mechanism 209B that may be made of steel.

The spring mechanism 209B may be a Belleville spring or a stack of Belleville springs to control the spring constant or amount of deflection. The springs are stacked in alternating directions resulting in greater deflection. The spring mechanism 209B may also be stacked in the same direction creating a stiffer joint. Mixing and matching directions allow a specific spring constant and deflection capacity to be designed.

The pick 101B impacts the formation 104B in the direction of the arrow 214B creating pressure on the spring mechanism 209B. With applied pressure, the spring mechanism 209B compresses allowing the pick 101B to retract slightly from the formation 104B. When pressure is taken away from the pick 101B, it returns to its original position. Spring loading the pick 101B causes the picks 101B to vibrate and move in a recoiling motion 214B across the formation 104B which is optimized for the wear life of the pick 101B. The recoiling motion 214B reduces the effects of drag and eventual wear on the pick 101B. In some embodiments, when no pressure is applied to the pick 101B at least one of the Belleville springs generally has a 45 degree angle 213B from a pick central axis 250B. When the pick 101B engages the formation 104B and pressure is applied, the spring may potentially compress to a lesser angle.

The holder 207B is welded to a plate 210B horizontally bolted onto a chain 102B which moves in the direction of the arrow 215B. As the pick 101B travels and degrades the formation 104B, it carries the formation cuttings with it exposing new formation 104B for engagement with adjacent picks.

Figure 3:
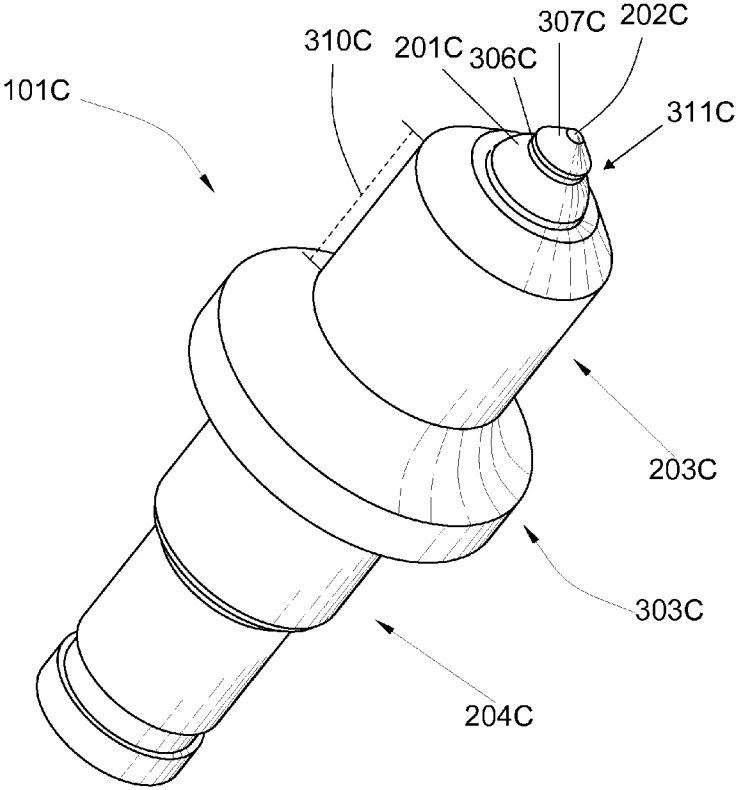
FIG. 3 is a perspective diagram of an embodiment of a pick.

FIG. 3 is a perspective diagram of an embodiment of a pick 101C. The pick 101C comprises a steel body 203C having a shank 204C extending from a base 303C of the steel body 203C. The steel body 203C may be formed of steel selected from the group consisting of 4140, 4130, S7, S5, A2, tool steel, hardened steel, alloy steels, PM M-4, T-15, M-4, M-2, D-7, D-2, Vertex, PM A-11, A-10, A-6, O-6, O-1, H-13, EN30B, and combinations thereof. A cemented metal carbide core 201C is press fit into the steel body 203C opposite the shank 204C. The steel body 203C may have a length 310C from a distal end 311C to the steel base 303C. In some embodiments of the invention, the carbide core 201C may be press fit into a majority of the length 310C of the steel body 203C. An impact tip 202C is bonded to a first end 306C of the metal carbide core 201C. The impact tip 202C has a working surface made of a superhard material 307C.

The superhard material 307C may be diamond, polycrystalline diamond with a binder concentration of 1 to 40 weight percent, cubic boron nitride, refractory metal bonded diamond, silicon bonded diamond, layered diamond, infiltrated diamond, thermally stable diamond, natural diamond, vapor deposited diamond, physically deposited diamond, diamond impregnated matrix, diamond impregnated carbide, monolithic diamond, polished diamond, course diamond, fine diamond, nonmetal catalyzed diamond, cemented metal carbide, chromium, titanium, aluminum, tungsten, or combinations thereof. The superhard material 307C may be a polycrystalline structure with an average grain size of 10 to 100 microns.

Figure 4:
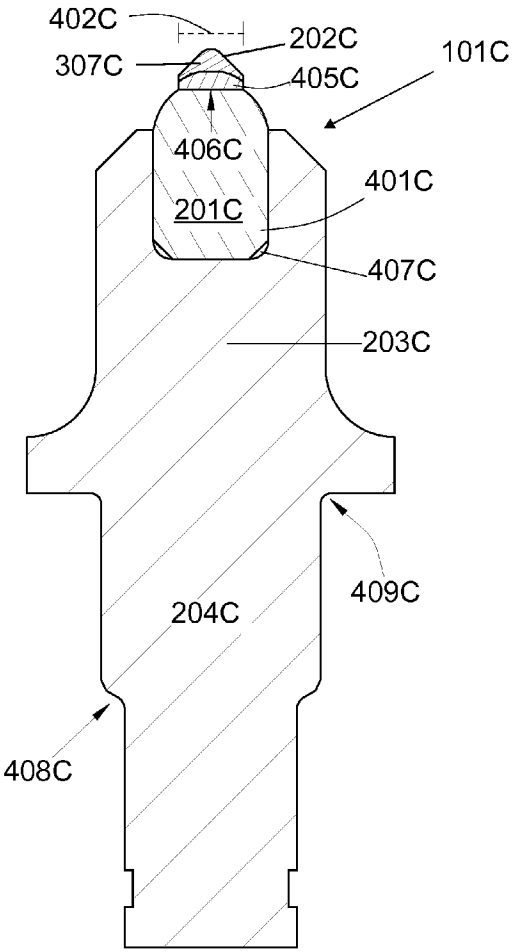
FIG. 4 is a cross-sectional diagram of the pick of FIG. 3.

Referring now to FIG. 4, which illustrates a cross-section of the pick 101C of FIG. 3, the core 201C of the pick 101C has a second end 401C and a diameter 402C. The superhard material 307C may be at least 4,000 HV and in some embodiments it may be 0.020 to 0.500 inches thick. In some embodiments, where the superhard material is a ceramic, the material may have a region, near its surface, that is free of binder material. Infiltrated diamond is typically made by sintering the superhard material 307C adjacent a cemented metal carbide substrate 405C and allowing a metal (such as cobalt) to infiltrate into the superhard material 307C. As disclosed in FIG. 4, the impact tip 202C may have a carbide substrate 405C bonded to the superhard material 307C. In some embodiments, the impact tip 202C may be connected to the core 201C before the core 201C is press fit into a recess 410 of the body 203C. Typically, the cemented metal carbide substrate 405C of the impact tip 202C is brazed to the core 201C at a planar interface 406C. The impact tip 202C and the core 201C may be brazed together with a braze having a melting temperature from 700 to 1200 degrees Celsius.

The superhard material 307C may be bonded to the cemented metal carbide substrate 405C through a high-temperature/high-temperature (HTHP). During HTHP processing, some of the cobalt may infiltrate into the superhard material such that the cemented metal carbide substrate 405C comprises a slightly lower cobalt concentration than before the HTHP process. The superhard material 307C may comprise a 6 to 20 percent cobalt concentration by volume after the cobalt or other binder infiltrates the superhard material 307C. The superhard material 307C may also comprise a 1 to 5 percent concentration of tantalum by weight. Other binders that may be used with the present invention include iron, cobalt, nickel, silicon, carbonates, hydroxide, hydride, hydrate, phosphorus-oxide, phosphoric acid, carbonate, lanthanide, actinide, phosphate hydrate, hydrogen phosphate, phosphorus carbonate, alkali metals, ruthenium, rhodium, niobium, palladium, chromium, molybdenum, manganese, tantalum or combinations thereof. In some embodiments, the binder is added directly to the superhard material's mixture before the HTHP processing and does not rely on the binder migrating from the substrate into the mixture during the HTHP processing.

The superhard material 307C may have a substantially pointed geometry with a sharp apex comprising a radius of 0.050 to 0.200 inches. In some embodiments, the radius is 0.090 to 0.110 inches. The apex may be adapted to distribute impact forces, which may help to prevent the superhard material 307C from chipping or breaking. The superhard material 307C may have a thickness of 0.100 to 0.500 inches from the apex to the interface with the substrate 405C, preferably from 0.125 to 275 inches. The superhard material 307C and the substrate 405C may comprise a total thickness of 0.200 to 0.700 inches from the apex to the cemented metal carbide core 201C. The sharp apex may allow the high impact resistant pick 101C to more easily cleave pavement, rock, or other formations.

A radius 407C on the second end 401C of the core 201C may have a smaller diameter than the diameter 402C of the cemented metal carbide core 201C. A reentrant 408C may be formed on the shank 204C near and/or at an intersection 409C of the shank 204C and the body 203C. Placing the reentrant 408C near the intersection 409C may relieve strain on the intersection 409C caused by impact forces.

Figure 5:
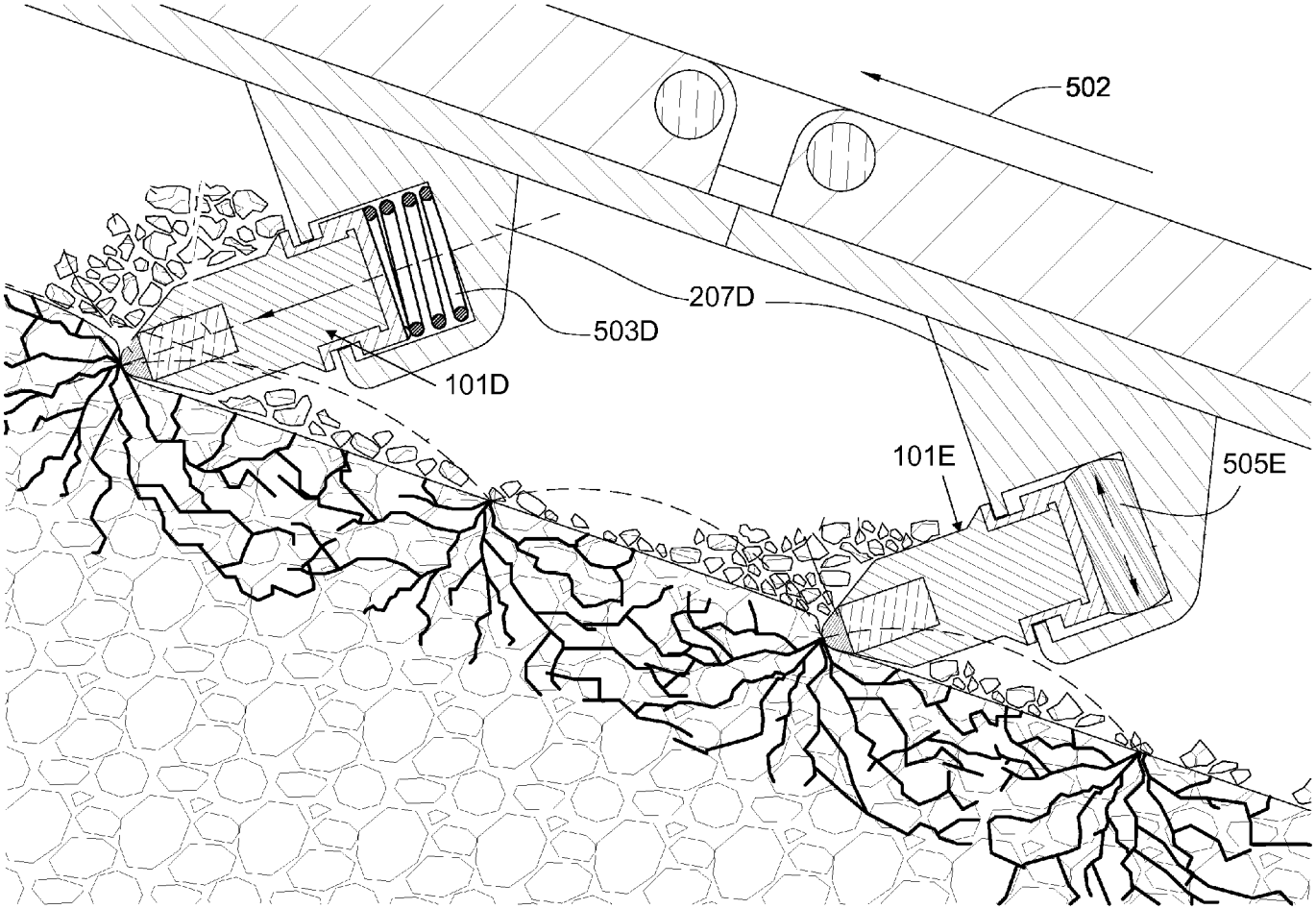
FIG. 5 is a cross-sectional diagram of another embodiment of a pick.

FIG. 5 is a cross-sectional diagram of other embodiments of picks 101D, 101E. In one embodiment, the pick 101D is axially spring loaded with a coil spring 503D. In another embodiment, the pick 101E is axially spring loaded with an elastomeric material 505E disposed within a holder 207D.

Figure 5A:
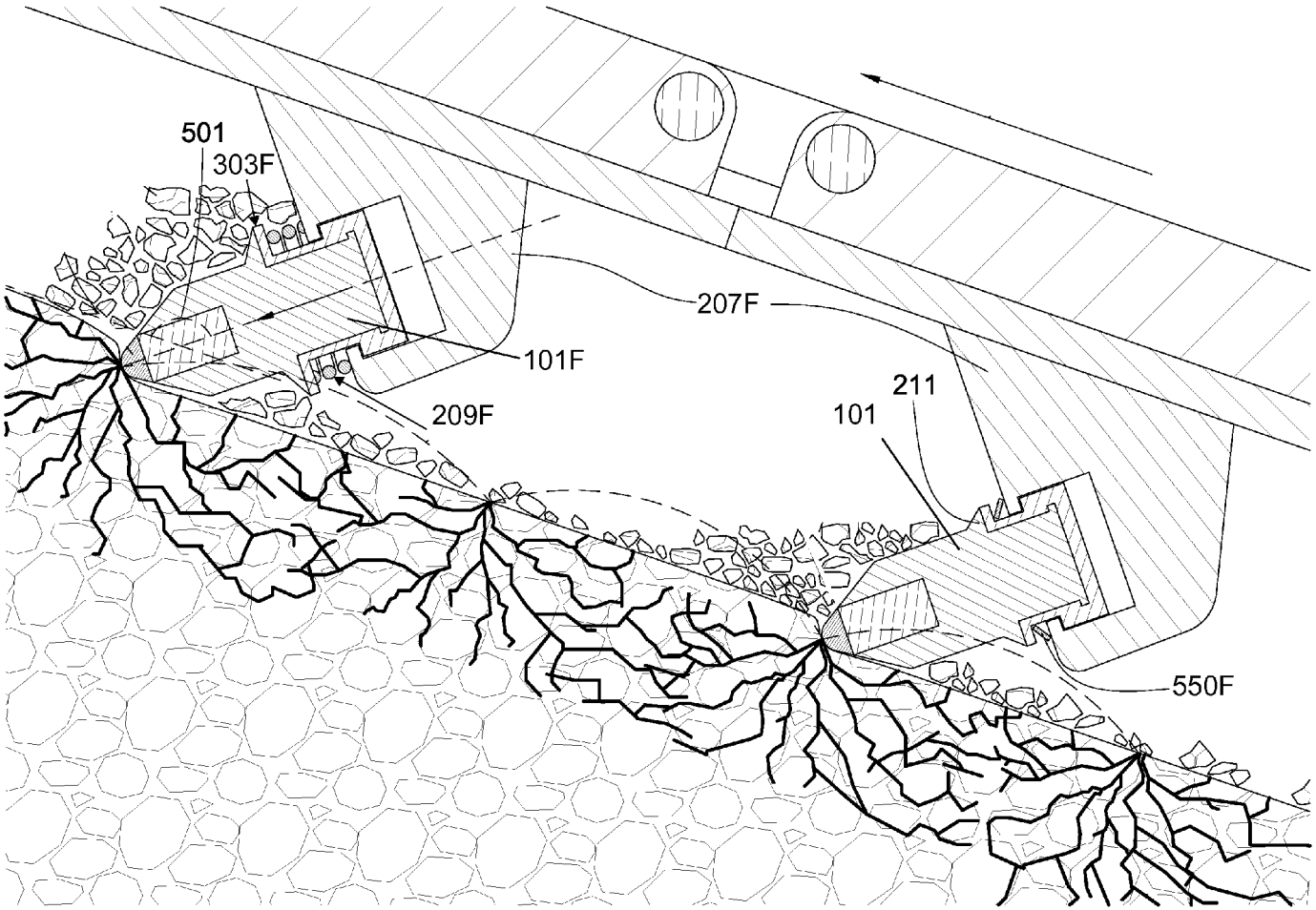
FIG. 5*a* is a cross-sectional diagram of another embodiment of a pick.

FIG. 5*a* discloses another embodiment of a spring mechanisms 209F between a base 203F of a pick 101F and a holder 207F. In some embodiments, the spring mechanism 209F may be a Bellville spring 550F or it may be a stack of Bellville springs.

Figure 5B:
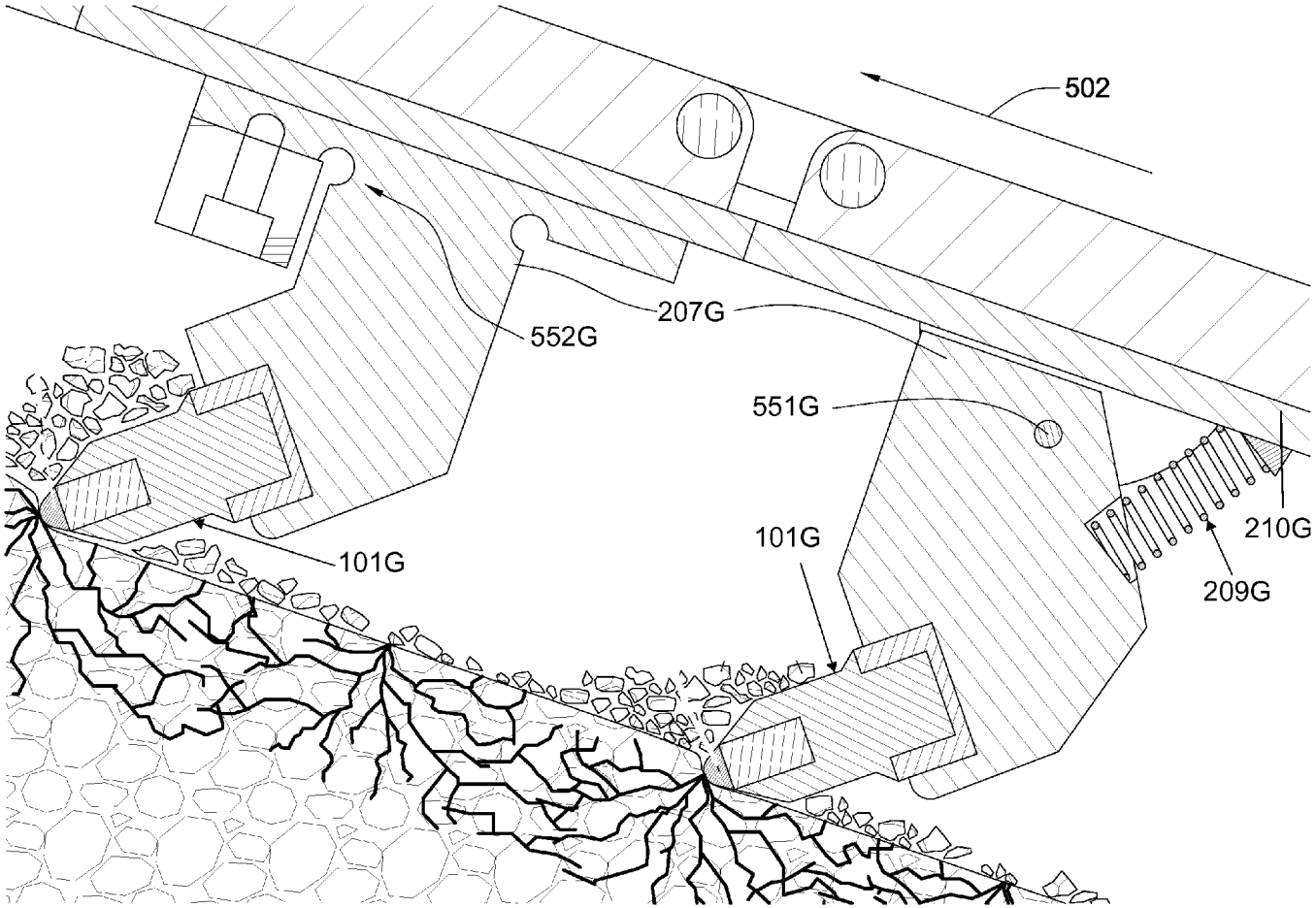
FIG. 5*b* is a cross-sectional diagram of another embodiment of a pick.

In the embodiments of FIG. 5*b*, a spring mechanism 209G may be incorporated into holders 207G. The spring mechanism 209G may be attached to a pivot 551G with the spring mechanism 209G pushing on the holder 207G. In some embodiments, the holder 207G may have a geometry 552G which inherently has a spring constant suited for trenching applications. Blocks may be used to control how the holders 207G vibrate. In other embodiments, the pick 101G may comprise an arrangement similar to a spring loaded center punch or a piano hammer to affect the vibration in the trenching action.

Figure 6:
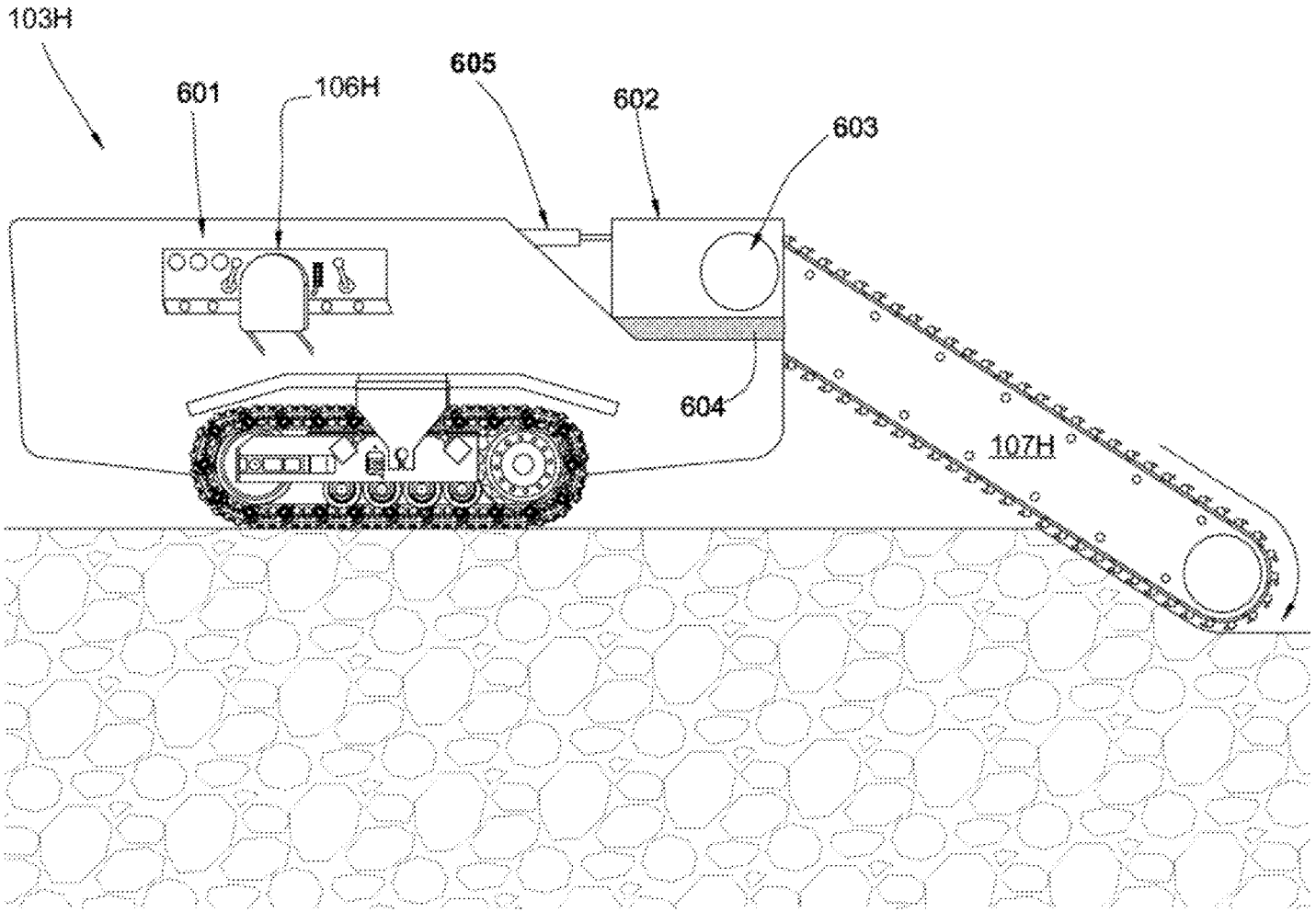
FIG. 6 is an orthogonal diagram of an embodiment of a trenching machine.

FIG. 6 is an orthogonal diagram of an embodiment of a trenching machine 103H with dampening elements which are in contact with an arm supporting block 602 on the trenching machine 103H. The arm supporting block 602 includes an axel 603 around which an arm 107H pivots. In one embodiment, the dampening element may be a hydraulic shock absorber 605 positioned between the arm supporting block 602 and the trenching machine 103H. The hydraulic shock absorber 605 may dampen the vibration felt by an operator at the operator's seat 106H on the trenching machine 103H. In some embodiments, the arm supporting block 602 o sits upon a dampening element such as an elastomeric material 604. The operator's seat 106H is positioned near a control panel 601 that controls the operations of the trenching machine 103H. In other embodiments of the invention, the trenching machine 103H may be controlled remotely, so that an operator positioned on the trenching machine 103H may not be necessary. In such embodiments, the trenching machine may 103H be controlled through Wi-Fi, Bluetooth, radio wave, or a combination thereof.

Figure 7:
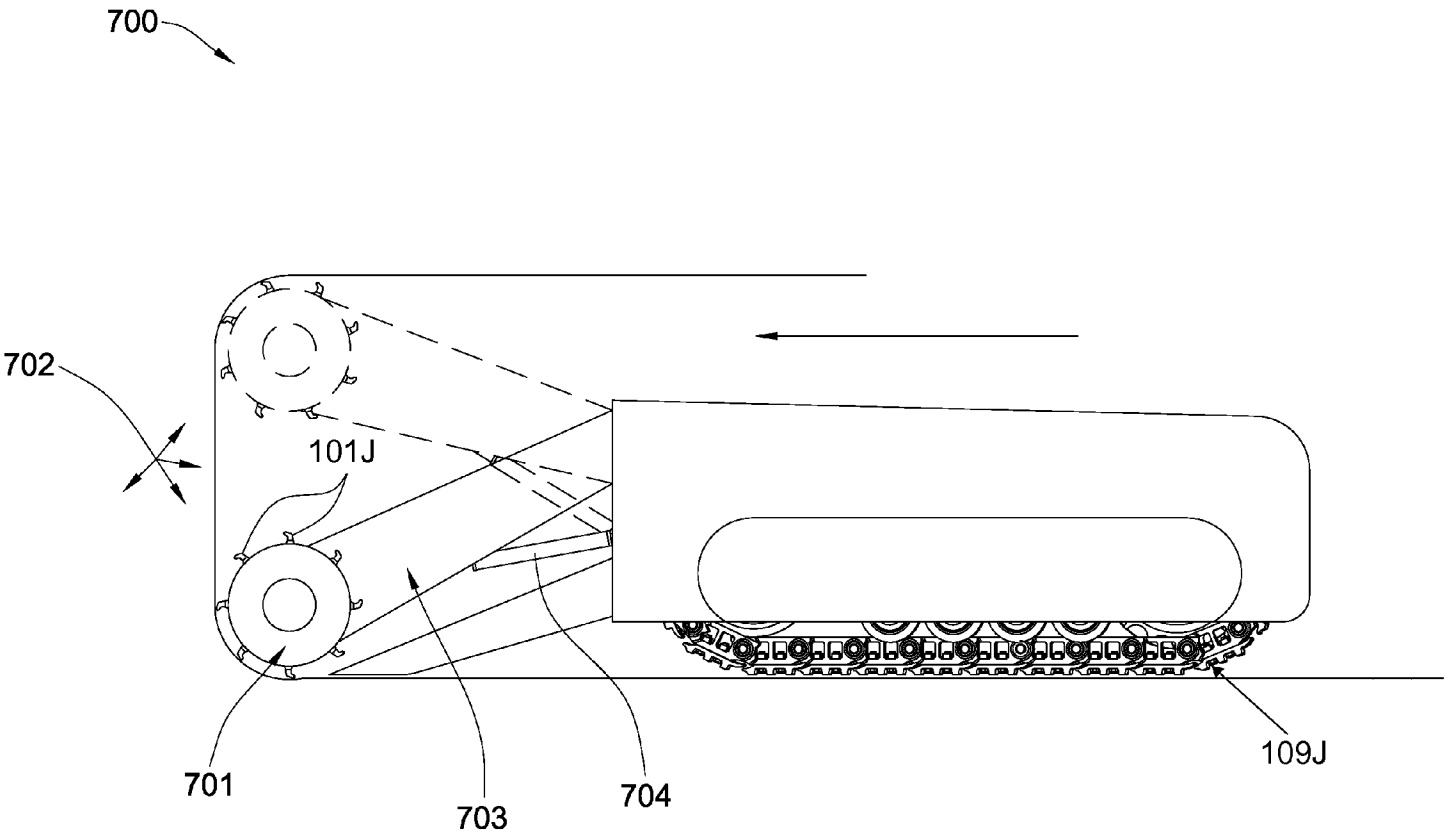
FIG. 7 is an orthogonal diagram of an embodiment of a coal trencher.

FIG. 7 is an orthogonal diagram of an embodiment of a coal trencher 700. A plurality of picks 101J are connected to a rotating drum 701 that is degrading coal 702. The rotating drum 701 is connected to an arm 703 that moves the rotating drum 701 vertically in order to engage the coal 702. The arm 703 may be moved by a hydraulic arm 704, it may also pivot about an axis or a combination thereof. The coal trencher 700 may move about by tracks 109J, wheels, or a combination thereof. The coal trencher 700 may also move about in a subterranean formation 704. The coal trencher 700 may be in a rectangular shape providing for easy mobility about the formation.

Figure 8:
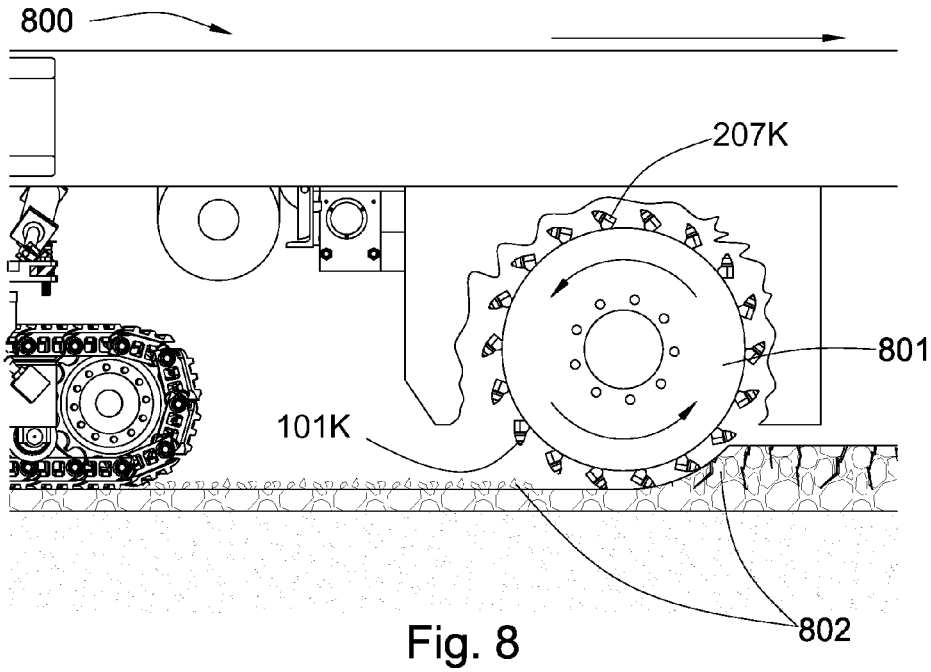
FIG. 8 is an orthogonal diagram of an embodiment of a milling machine.

FIG. 8 is an orthogonal diagram of an embodiment of a plurality of picks 101K attached to a rotating drum 801 connected to the underside of a pavement milling machine 800. The milling machine 800 may be a cold planer used to degrade man-made formations such as pavement 802 prior to the placement of a new layer of pavement. Picks 101K may be attached to the rotating drum 801 bringing the picks 101K into engagement with the formation 802. A holder 207K is welded to the rotating drum 801K, and a pick 101K is inserted into the holder 207K. The holder 207K may hold the pick 101K at an angle offset from a direction of rotation, such that the pick 101K engages the pavement 802 at a preferential angle.

Figure 9:
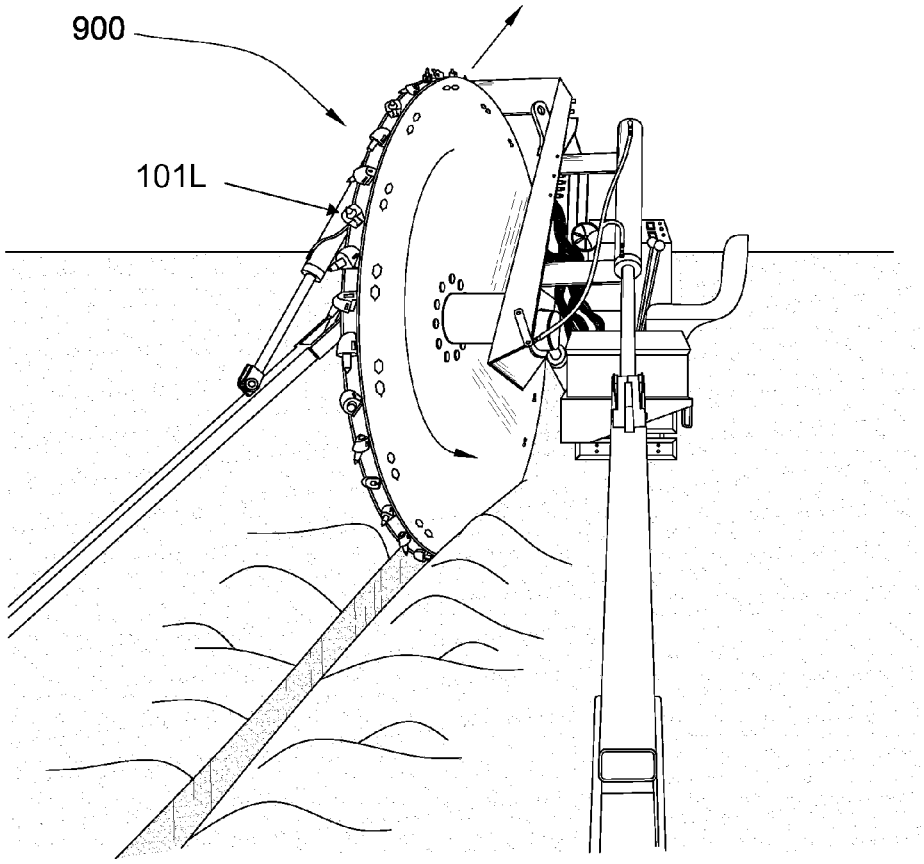
FIG. 9 is a perspective diagram of another embodiment of a trencher.

The pick 101A may be used in a trenching machine, as disclosed in FIGS. 1 and 8. Picks 101L may be disposed on a rock wheel trenching machine 900 as disclosed in FIG. 9. Other applications that involve intense wear of machinery may also be benefited by incorporation of the present invention. Milling machines, for example, may experience wear as they are used to reduce the size of material such as rocks, grain, trash, natural resources, chalk, wood, tires, metal, cars, tables, couches, coal, minerals, chemicals, or other natural resources. Various mills that may incorporate the composite material include mulchers, vertical shaft mills, hammermills, cone crushers, chisels, jaw crushers, or combinations thereof. In some embodiments of the invention, rigid picks may be used in combination with picks that are axially spring loaded.

Figure 10:
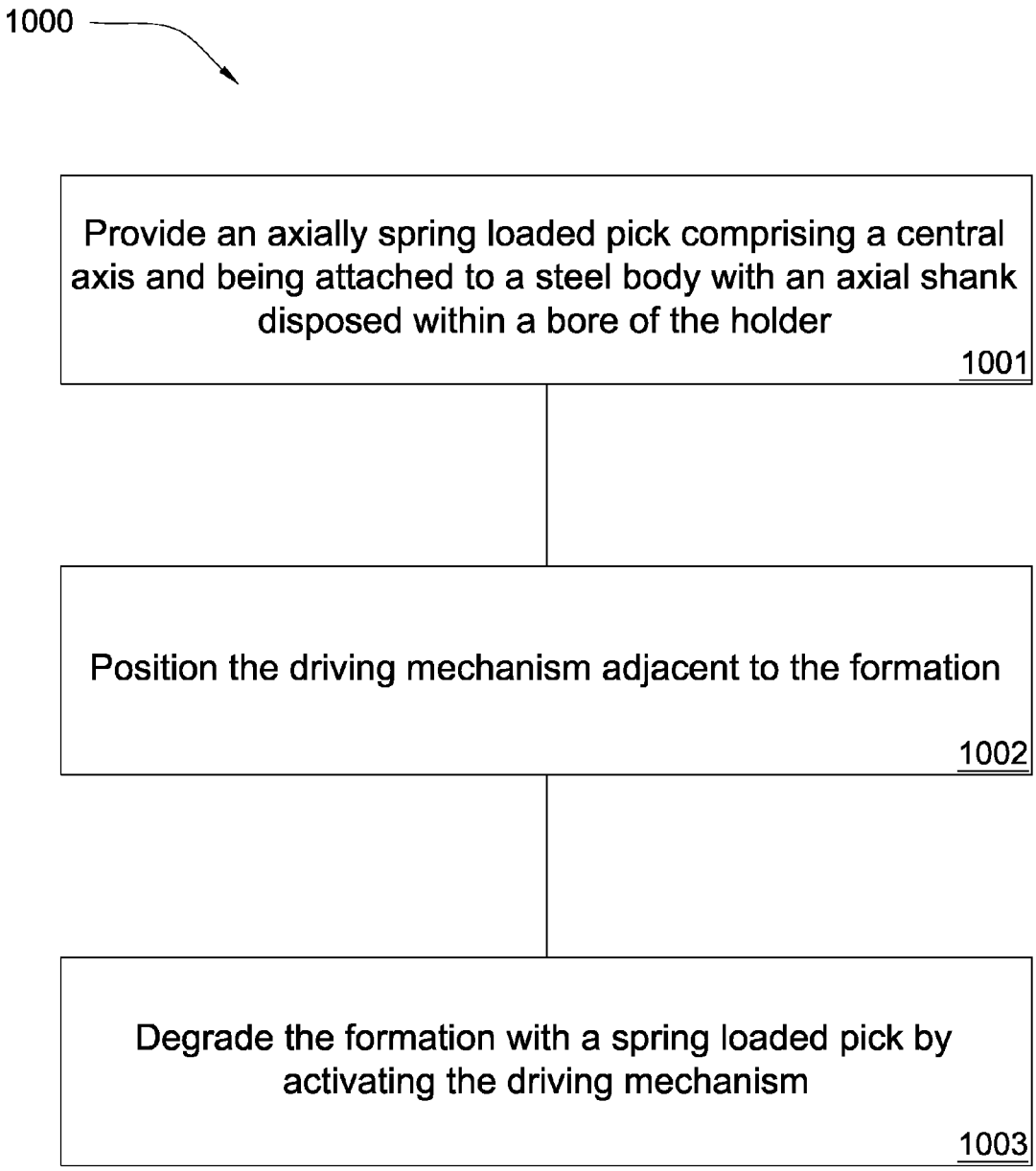
FIG. 10 is a flowchart illustrating an embodiment of a method for degrading natural and manmade formations.

Referring now to FIG. 10 and FIG. 2, a method 1000 of degrading natural or man-made formations is disclosed. The method 1000 comprises a step 1001 of providing an axially spring loaded pick 101B attached to a holder 207B secured to a driving mechanism such as the chain 102B of FIG. 2, degrading a natural or man-made formations 104 B. The pick 101 comprises a steel body 203B with an axial shank 204B302 disposed within a bore of the holder 207B 202 and has an impact tip 202B305 with a hardness of greater than 4000 HV. The method 1000 further comprises a step 1002 of positioning the driving mechanism adjacent to the formation 104B. The method 1000 further comprises a step 1003 of degrading the formation 104B with a spring loaded pick 101B by activating the driving mechanism.

Whereas the present invention has been described in particular relation to the drawings attached hereto, it should be understood that other and further modifications apart from those shown or suggested herein, may be made within the scope and spirit of the present invention.

What is claimed is:

1. A pick apparatus adapted for degrading at least one of natural and man-made formations, comprising:
   - a steel body that includes a shank extending rearward and a recess at a front end of said steel body, said shank including a flange;
   - a carrier sized and shaped to receive said shank in a press fit, said carrier having a recess sized and shaped to receive said flange;
   - a holder having a cavity adapted to receive said carrier;
   - a carbide core having a tip that includes a diamond material, said carbide core sized and shaped to be inserted into said recess of said steel body; and
   - a spring mechanism adapted to bias said carrier in a forward position, said spring mechanism at least partly encircling said shank; and,
   - wherein said carrier includes indents and said holder includes fingers, wherein said fingers interface with said indents and limit axial movement of said carrier relative to said holder.

2. The pick apparatus of claim 1, wherein said recess of said steel body is disposed opposite said shank.

3. The pick apparatus of claim 1, wherein said spring mechanism is located between said carrier and said holder, wherein said spring mechanism biases said carrier in a forward position relative to said holder.

4. The pick apparatus of claim 3, wherein said spring mechanism is disposed external to said cavity adapted to receive said carrier.

5. The pick apparatus of claim 1, further comprising a driving mechanism, wherein said holder is secured to said driving mechanism.

6. A pick apparatus adapted for degrading formations, the pick apparatus comprising:

a core having a tip that includes a diamond material;

a body having a shank with a flange, said body mechanically coupled to said core;

a carrier sized and shaped to receive said shank, said carrier having a recess sized and shaped to receive said flange, said recess and said flange mechanically coupling said shank with said carrier; said carrier includes a carrier cavity sized and shaped to receive said shank; said shank is press fit within said carrier cavity; said carrier including indents;

a holder that includes a holder cavity having fingers disposed proximate said holder cavity, said fingers received in said indents to mechanically couple said holder to said carrier; and a spring mechanism adapted to bias said tip in a forward position, said spring mechanism at least partly encircling a portion of said body.

7. The pick apparatus of claim 6, wherein said body includes a body recess sized and shaped to receive said core.

* * * * *